US005373788A

United States Patent [19]

Schoen

[11] Patent Number: 5,373,788

[45] Date of Patent: Dec. 20, 1994

[54] PRINTING APPARATUS FOR OFFSET PRINTING, PRINTING BELT AND PRINTING ROLLER THEREFOR, AND METHOD FOR THE MANUFACTURE OF SUCH A PRINTING BELT AND PRINTING ROLLER

[75] Inventor: David Schoen, La Amsterdam, Netherlands

[73] Assignee: Drukband Holland B.V., Amsterdam, Netherlands

[21] Appl. No.: 969,827

[22] PCT Filed: Jul. 19, 1991

[86] PCT No.: PCT/NL91/00131

§ 371 Date: Mar. 29, 1993

§ 102(e) Date: Mar. 29, 1993

[87] PCT Pub. No.: WO92/01561

PCT Pub. Date: Feb. 6, 1992

[30] Foreign Application Priority Data

Jul. 20, 1990 [NL] Netherlands ..... 9001666

[51] Int. Cl.[5] ..... B41F 13/10

[52] U.S. Cl. ..... 101/219; 101/375; 101/376; 355/212

[58] Field of Search ..... 101/375, 378, 376, 111, 101/219; 355/412, 413

[56] References Cited

U.S. PATENT DOCUMENTS

| | | | |
|---|---|---|---|
| 2,066,179 | 12/1936 | Keller | 101/111 |
| 2,901,540 | 8/1959 | Canepa | 101/111 |
| 4,178,094 | 12/1979 | Silverberg | 355/212 |
| 4,462,676 | 7/1984 | Shimura et al. | 355/212 |
| 4,480,935 | 11/1984 | Kurihara et al. | 400/146 |
| 4,758,486 | 7/1988 | Yamazaki et al. | 355/212 |

FOREIGN PATENT DOCUMENTS

| | | | |
|---|---|---|---|
| 1204239 | 11/1965 | Germany . | |
| 0057467 | 3/1982 | Japan | 101/111 |
| 0214167 | 12/1983 | Japan | 355/212 |
| 0181166 | 7/1990 | Japan | 355/212 |
| 7506264 | 11/1976 | Netherlands | 355/212 |
| 494125 | 7/1970 | Switzerland . | |
| 857013 | 12/1960 | United Kingdom . | |
| 1085443 | 10/1967 | United Kingdom . | |

*Primary Examiner*—Eugene H. Eickholt
*Attorney, Agent, or Firm*—Bachman & LaPointe

[57] ABSTRACT

A printing apparatus comprises a printing roller (1) provided with a profile which containing (8) raised and lowered (9) parts in circumferential direction, a printing belt (3) provided at one side with a complementary profile, and an opposite roller (2) which together with the printing roller (1) determines a nip through which the printing belt (3) runs, in such a way that its profile side interacts with the printing roller, and its printing side interacts with the impression roller, which printing belt (3) is composed of an interlocked strip of plate material which is flexible as regards bending and is rigid as regards deformations in its plane, on one side of which a profiling of another, for instance rubbe-like, material is provided. Preferably, the profiling is carried out in the form of conical projections (6) distributed at regular intervals over the plate surface in question, and the printing roller (3) is provided with complementary recesses (9) distributed in a corresponding manner over its surface.

5 Claims, 4 Drawing Sheets

PRINTING APPARATUS FOR OFFSET PRINTING, PRINTING BELT AND PRINTING ROLLER THEREFOR, AND METHOD FOR THE MANUFACTURE OF SUCH A PRINTING BELT AND PRINTING ROLLER

BACKGROUND OF THE INVENTION

The present invention relates to a printing apparatus with a printing roller provided with a profile which comprises raised and lowered parts in circumferential direction, a printing belt provided at one side with a complementary profile, and an opposite roller which together with the printing roller determines a nip through which the printing belt runs, in such a way that its profile side interacts with the printing roller, and its printing side interacts with the opposite roller.

Such a printing apparatus is known from Dutch Application 8700431. In the case of this known printing apparatus the printing belt is made of a flexible, rubber-like material on which printing plates containing the printing image are placed. The flexible belt is provided with teeth running in the crosswise direction which interact with complementary teeth provided on the printing roller. The purpose of these interacting teeth is to position the printing plates correctly with the web of paper to be printed, which must also be guided through the nip between printing roller and impression roller.

This known printing apparatus has various disadvantages. The first disadvantage is that the flexible printing belt has a varying flexural rigidity, viewed in its lengthwise direction. At the position of the teeth the printing belt is thicker and therefore more rigid than at the places between the teeth. This means that the printing plates do not run in an accurate circular shape around the printing roller and through the nip, but at the position of the teeth are more flattened than at the places between the teeth. This leads to imperfections in the image printed on the web of paper.

A further disadvantage of this known printing belt arises from the fact that it is made of relatively flexible material. As a result of the undercut, in other words the distance over which the impression roller presses in the printing belt, a certain displacement of the flexible material occurs at the position where it is pressed in. This displacement manifests itself in a widening of the pressed-in material, which leads to the image on the printing plates also being widened. A point in the image to be printed, for example, acquires greater dimensions as a result, which adversely affects the printing obtained on the paper web.

SUMMARY OF THE INVENTION

The object of the invention is to provide a printing apparatus of the above-mentioned type which does not have these disadvantages. This is achieved in that the printing belt is composed of an interlocked strip of plate material which is flexible as regards bending and is rigid as regards deformations in its plane, on one side of which a profiling of another material is provided. The printing belt according to the invention has a printing surface which consists entirely of the plate material suitable for offset printing. This means that deformation of the image in the plane of said plate material is virtually out of the question. Contrasting with the known apparatuses, in which the images to be printed were on separate plates which were interconnected by a flexible printing belt, the correct relative positions of the images can be ensured in this way.

It is also no longer possible for point widening to occur as a result of the undercut, as in the case of the known printing apparatus described above.

As a result of the profiling present on one side of the printing belt, it can be accurately positioned relative to the paper web to be printed. In view of the constant flexural rigidity of the plate material in the lengthwise direction of the strip, it can be guided around the printing roller with a constant radius of curvature. No flattening or sharper curves occur as in the case of the known apparatus.

This uniform curvature, arising from a uniform flexural rigidity in the lengthwise direction of the printing belt, can be beneficially influenced further by carrying out the profiling in a more flexible material than the plate material. According to the invention, this is achieved in that the profiling consists of a flexible, rubber-like material which is bonded to the plate material. In this way the profiling can be carried out in the form of projections distributed at regular intervals over the plate surface in question, while the printing roller can be provided with complementary recesses distributed in a corresponding manner over its surface. The effect of these projections on the flexural rigidity of the printing belt is negligible, which means that a further improvement of the uniform running thereof through the nip can be ensured. The strip of plate material is also held in the crosswise direction with regard to the printing roller by the projections interacting with the recesses therein, as a result of which the correct position of the printing belt with regard to the paper web to be printed is also ensured in that direction.

The projections preferably form parallel rows which form an angle with the generating line of the printing roller. The advantage of this design is that a vibration-free run of the printing belt over the pressure roller is thereby obtained.

In order to ensure good interaction between projections and recesses, they are in the form of a truncated cone. This conical shape also ensures that the projections can be accommodated in a more or less self-centring manner in the recesses.

The printing belt can also have transverse grooves at regular intervals in the lengthwise direction at the printing side, the depth of which is greater than the undercut. Such a design is advantageous when several printing apparatuses according to the invention are being used in series, and through which one and the same paper web is being guided. The transverse grooves in the printing belt mean that it can be ensured that no undesirable vibrations occur in the section of the paper web between two printing apparatuses. Tensile stresses are built up in the paper web during the printing. Once the gap now arrives at the paper web, these tensile stresses can be released, which benefits the run of the paper web.

The invention also relates to an image carrying belt composed of an interlocked strip of plate material which is flexible as regards bending and which is rigid as regards deformations in its plane, on one side of which a profiling of another material is provided. Such belt is suitable for use in a printing apparatus as described above. However, it may also be used in a photographic image developing apparatus as will be discussed below.

Furthermore, the invention is related to a printing roller for a printing apparatus described above.

The invention also relates to a method for the manufacture of a printing belt comprising an interlocked strip of plate material with projections of a flexible material on the printing side. According to the invention, the projections are to this end cut, punched or the like out of a strip of rubber material in such a way that they are still connected to said strip by a bridge which is simple to break, and are then bonded to the strip of plate material, following which the strip of rubber-like material is removed in such a way that the bridges between the projections and said strip of rubber-like material are broken.

The projections in this case adhere so strongly to the strip of plate material that they remain on it when the remainder of the strip is pulled away. For this, an adhesive layer is preferably applied to each projection.

Finally, the transverse grooves in the printing belt can be formed by cutting to a greater depth than the undercut.

If the printing belt is made of a material to which the printing image can be applied photographically, the printing belt is exposed only after fixing of the projections. The advantage of this method is that the printing belt can also be positioned accurately relative to the exposure device by means of the projections already applied.

The invention also relates to a method for the manufacture of a printing roller with complementary recesses formed for the projections on the printing belt. For this, a strip of rubber-like material is applied to the periphery of the printing roller, of a length corresponding to the size of said periphery, in which strip recesses are provided by removing projections from them during the production of the printing belt. In this method it is ensured that the recesses in the strip of rubber-like material on the printing roller are always accurately complementary relative to the projections on the printing belt. Said strip of rubber-like material, together with the projections therein fixed to the strip of plate material, also provides a flexible layer under said strip of plate material with a constant thickness. This strip of rubber-like material, together with the projections in the recesses thereof, can accommodate the undercut, the rubber-like material being pressed in a little.

According to a preferred method, the projections are punched out whereby during the printing operation at least at the location of the material to be punched out, the strip of rubber-like material is gradully stretched in its plane in a generally circular-symmetrical fashion, in such a way that a conical hole is formed.

To this end, furthermore an apparatus for carrying out this method is provided, comprising support and clamping means for clamping the strip of rubber-like material at the circumference of at least one location for punching a recess, mandrel means for pushing the strip of rubber-like material out of its plane of clamping so as to stretch it, and punching means opposite the mandrel means, which punching means are operable for punching a recess after or during operation of the mandrel means. Preferably, the apparatus is provided with a support plate, a pressure plate with at least one circular opening for pressing a strip of rubber-like material onto the support plate, which support plate is provided with a hole containing a mandrel which is movable in the hole, and a hollow punch opposite the mandrel whereby mandrel and punch are displaceable between a first position at a relatively large distance from each other in which a strip of rubber like material is being placed on the support plate, and a position at a small distance or in contact with each other.

The projections can be cut in various ways out of the strip of rubber-like material. The projections are, however, preferably cut out by cutting with a high-pressure water jet.

BRIEF DESCRIPTION OF THE DRAWINGS

The invention will be explained in greater detail below with reference to an example of an embodiment.

DETAILED DESCRIPTION

Figure 1:
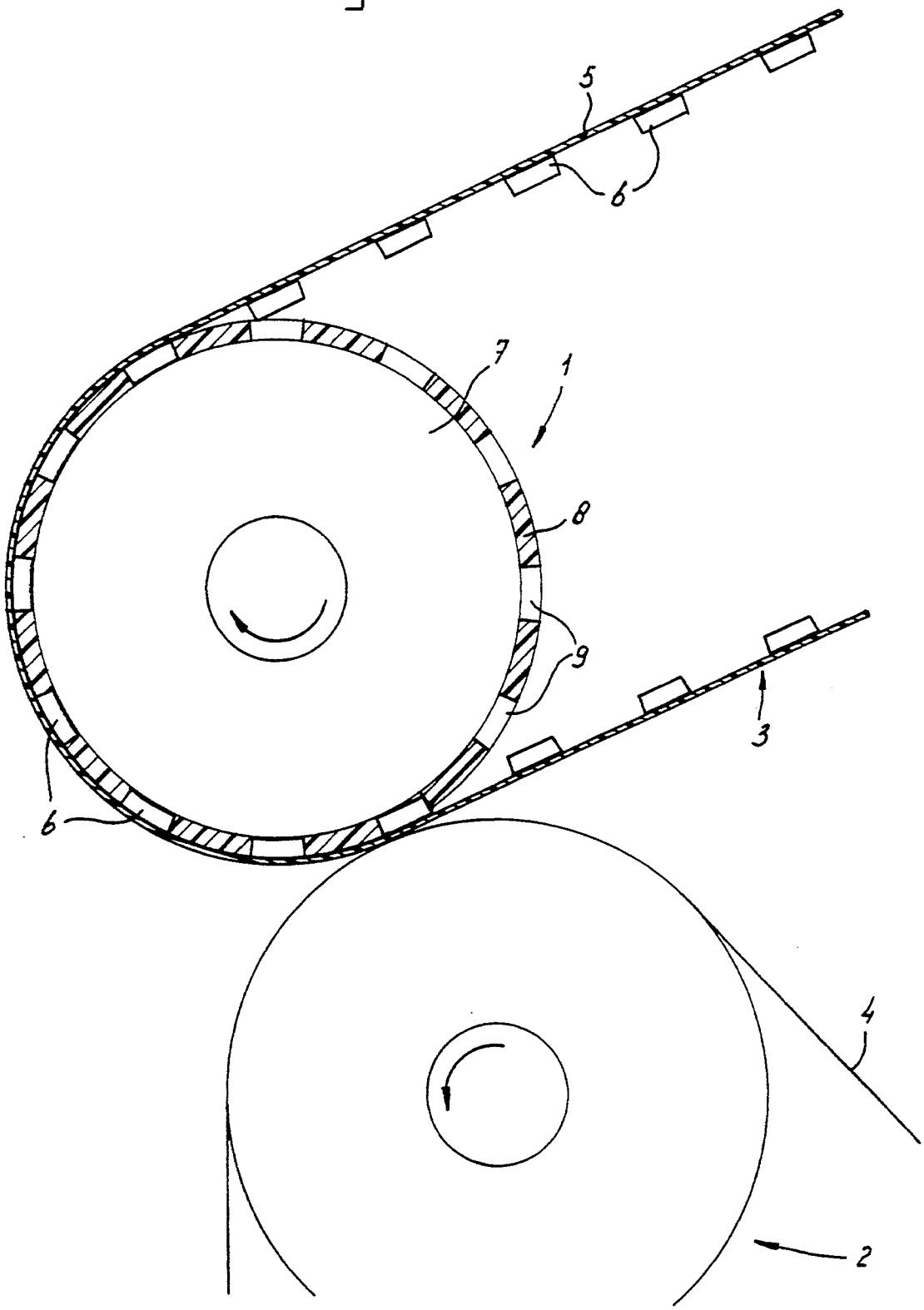
FIG. 1 shows a side view of a printing roller with printing belt according to the invention.

FIG. 1 shows the printing roller 1, the impression roller 2 and the printing belt 3. The printing belt 3 runs together with the paper web 4 through the nip between printing roller 1 and impression roller 2. Printing belt 3 is composed of an interlocked strip of plate material 5, on which projections are provided on the side facing the printing roller 1.

The plate material 5 can be a material suitable for offset printing to which the printing image can be applied photographically. This material is relatively rigid to deformations in its plane, but is flexible enough to be guided around the printing roller 1. When the printing belt 3 and the paper web 4 are moving together through the nip the image on the printing belt is printed on the web. The parts of the printing apparatus by means of which ink is applied to the printing side of the printing belt 3 are generally known, and are therefore not described in the present application.

As shown further in FIG. 1, the printing roller 1 comprises a metal cylinder 7 to which a covering 8 is applied. Holes 9, which correspond as regards shape and positioning to the projections 6 on the printing belt 3, are made in this covering 8. This covering 8 is preferably of the same material as the projections 6. Both are therefore preferably made of a rubber-like material. At the position of the nip between the strip of plate material 5 containing the image to be printed and the cylinder 7 there is thus a compressible layer which can easily accommodate the undercut. Despite the possibility of pressing in the strip of plate material 5 and the covering 8, the strip of plate material 5 will not deform in its plane, since it is rigid there.

Figure 2:
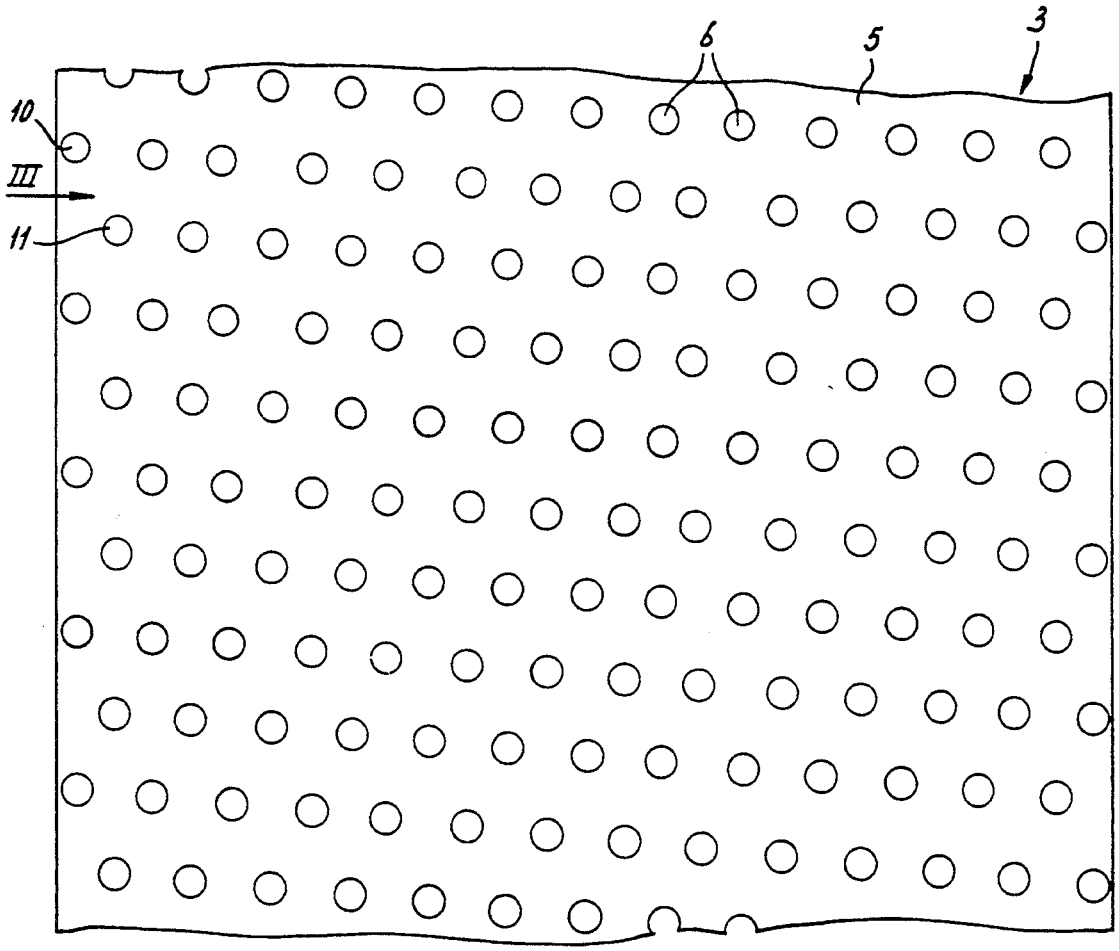
FIG. 2 shows a bottom view of a part of the printing belt according to the invention.

FIG. 2 shows the side of the printing belt 3 facing the printing roller 1. As can be seen clearly, there are a large number of projections on that side which are all preferably fixed thereto by gluing. A very good positioning of the printing belt 3 both in the peripheral direction of the printing roller 1 and in the axial direction of the printing roller 1 is thus obtained.

As can also be seen in FIG. 2, the projections run in rows across the printing belt. These rows do not, however, form a right angle with the sides of the printing belt. They run at an angle which is less than 90°. The advantage of this is that when the printing belt runs onto the printing roller only very small vibrations or none at all are produced.

Figure 3:
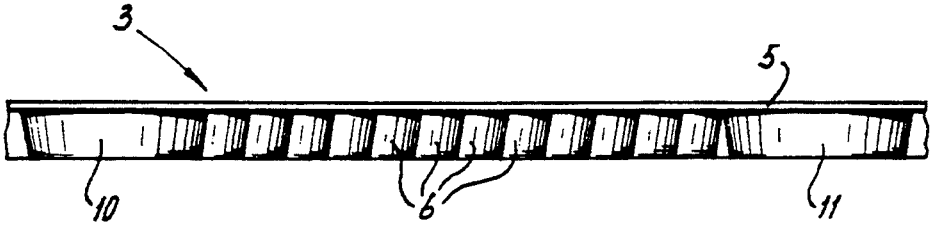
FIG. 3 shows a view along III of FIG. 2 of the printing belt.

FIG. 3 shows the view along the line III in FIG. 2. The displaced position of the projections in one row can be seen clearing. Projections 10 and 11 are shown in both FIG. 2 and FIG. 3. It can also be seen in FIG. 3 that the projections taper towards their free end.

Figure 4:
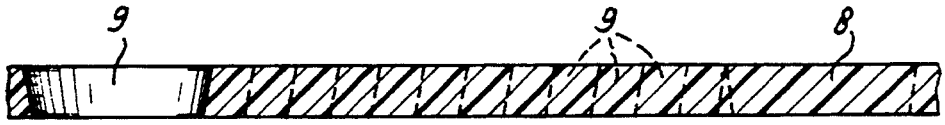
FIG. 4 shows a part of a covering to be applied around the printing roller, with recesses for the projections.

Corresponding tapering holes 9 are provided in the covering layer 8. In FIG. 4 this layer 8, which must be applied to the cylinder 7 of the printing roller 1, is shown in a flattened-out state. This strip of covering material 8 is preferably made by cutting the projections 6 out of it. A strip of covering material 8 in which the projections provided on the printing belt 3 fit accurately is thus obtained. As already mentioned above, this can be achieved in a simple way by gluing the projections 6, adhering first of all by means of small bridges to the strip 8, on the cylinder 7, and then pulling away the strip 8. The projections remain adhering to the strip of plate material 5. If the covering layer is then shortened in such a way that it fits closely around the cylinder 7, an excellent interaction between the printing belt 3 and the printing roller 8 can be achieved in this way.

Figure 5:
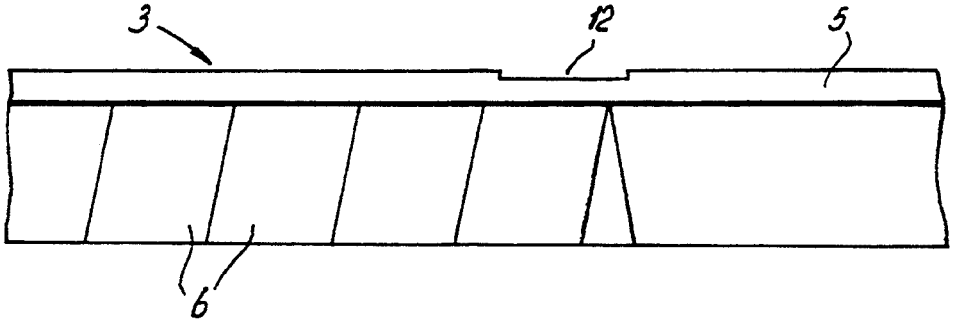
FIG. 5 shows an enlarged detail of the printing belt.

FIG. 5 shows an enlarged detail of the view of FIG. 3. In the surface facing the paper web, which thus bears the printing image of the strip of plate material 5, provision is made for a recess 12 extending crosswise to the printing belt, and the depth of which recess is greater than the undercut. This recess has the advantage already described above that it suppresses the occurrence of vibrations and tensile stresses in the paper web if the paper web is being printed in succession by two printing belts according to the invention.

Figure 6:
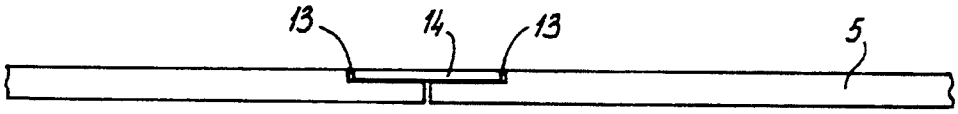
FIG. 6 shows a second detail of the printing belt.

Finally, FIG. 6 shows how the strip of plate material 5 is interlocked. The ends of the strip facing each other are to this end hollowed out a little (see the recesses 13). A layer of film of approximately the same thickness as the depth of the recess is glued into these recesses 13.

FIGS. 7–10 show a schematic representation of an apparatus for punching a conical hole in covering 8. Said apparatus comprises a support table 15, onto which the covering 8 is applied. A clamping ring 16 firmly clamps covering 8 onto support table 15. Said clamping ring 16 is held by a control mechanism which is not shown in the figures.

Furthermore, a mandrel 17 is provided, as well as a hollow punch 18.

Figure 7:
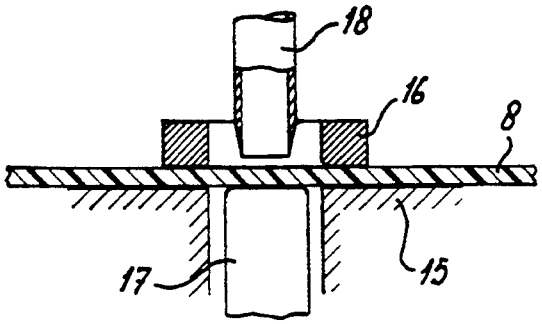
FIG. 7–10 show a punching apparatus at various stages in the process of punching.
Figure 8:
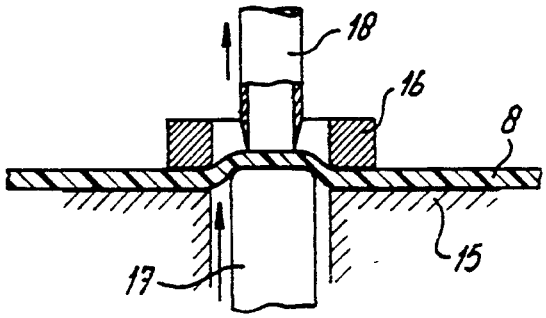

As shown in FIG. 7, initially the covering 8 is laying flat on top of the punch 17 and the support table 15. Once the covering 8 has been clamped properly by clamping rings 16, both mandrel 17 and hollow punch 18 are moved upwardly. However, as shown by the arrows in FIG. 8 mandrel 17 is being moved upwardly more rapidly than hollow punch 18. The covering 8 is drawn out of its plane by the movement of mandrel 17, and due to the lower speed of displacement of hollow punch 18 the distance between punch 18 and covering 8 gradually becomes smaller.

This means that the hollow punch 18 gradually cuts deeper and deeper into the covering 8 and that simultaneously, due to the fact that mandrel 17 is constantly moving in an upward direction, the part 19 to be cut out is being stretched more and more.

Figure 9:
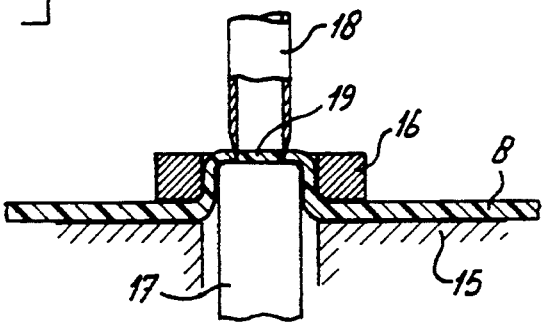

Once the position of mandrel 17 and hollow punch 18 as shown in FIG. 9 has been reached, the upward movements are stopped. At that point in the cutting cycle, part 19 has been cut out of the covering 8. Subsequently, mandrel 17 and hollow punch 18 are being moved to the initial position, as shown in FIG. 7.

Figure 10:
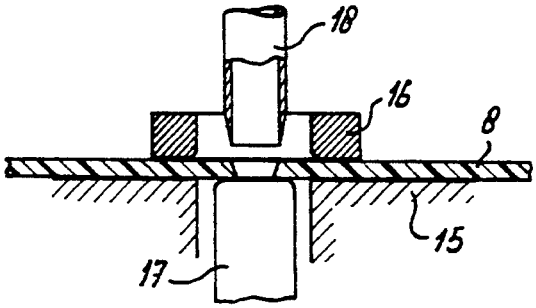

Due to the simultaneous stretching and cutting operation, a conical hole 9 has been formed, as shown in FIG. 10.

Furthermore, the part 19 cut out of the covering 8 has a corresponding conical form.

I claim:

1. A printing apparatus having an impression roller and a printing roller provided with a profile which comprises raised and lowered parts in circumferential direction, a printing belt provided at one side with a complementary profile, and an opposite roller which together with the printing roller determines a nip through which the printing belt runs, in such a way that its profile side interacts with the printing roller, and its printing side interacts with the impression roller, the improvement which comprises the printing belt is composed of an interlocked strip of plate material which is flexible as regards bending and is rigid as regards deformations in its plane, the profiling on the printing belt comprises flexible rubber-like material provided with a plurality of projections distributed at regular intervals thereon, said flexible rubber-like material being bonded to the plate material, and wherein the printing roller is covered with a layer of flexible, rubber-like material provided with a plurality of recesses distributed at regular intervals thereon for receiving the projections for holding the printing belt against movement both longitudinally and laterally relative to the printing roller.

2. A printing apparatus according to claim 1 wherein the projections form rows parallel to each other.

3. A printing apparatus according to claim 1 wherein the projections are the shape of a truncated cone.

4. A printing apparatus according to claim 1 wherein the printing belt is provided with transverse grooves at regular intervals in the lengthwise direction at the printing side wherein the depth of the grooves is greater than the undercut.

5. A printing apparatus according to claim 1 wherein a second printing belt with second printing roller is provided, the first and the second printing roller determining a nip through which the first and the second printing belt run.

* * * * *